US008550742B2

(12) United States Patent
Leroyer

(10) Patent No.: US 8,550,742 B2
(45) Date of Patent: Oct. 8, 2013

(54) ANTI-UNLOCK DEVICE FOR CONNECTOR

(75) Inventor: Serge Leroyer, Le Mans (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 13/021,203

(22) Filed: Feb. 4, 2011

(65) Prior Publication Data

US 2011/0194911 A1 Aug. 11, 2011

(30) Foreign Application Priority Data

Feb. 5, 2010 (FR) ..... 10 50819

(51) Int. Cl.
*H01R 4/38* (2006.01)

(52) U.S. Cl.
USPC ..... 403/342; 439/321

(58) Field of Classification Search
USPC ..... 403/105, 322.2, 342, 350–352; 439/321, 352, 363, 372; 285/360, 362, 285/395, 401
See application file for complete search history.

(56) References Cited

U.S. PATENT DOCUMENTS

| | | | | | |
|---|---|---|---|---|---|
| 2,365,327 | A | * | 12/1944 | Barnes | 166/196 |
| 2,636,068 | A | * | 4/1953 | Perkins | 439/197 |
| 3,601,764 | A | * | 8/1971 | Cameron | 439/315 |
| 3,869,186 | A | * | 3/1975 | Vetter | 439/321 |
| 3,967,507 | A | * | 7/1976 | Emms | 74/6 |
| 4,235,498 | A | * | 11/1980 | Snyder | 439/319 |
| 4,257,663 | A | | 3/1981 | Brush et al. | |
| 4,487,470 | A | | 12/1984 | Knapp et al. | |
| 4,632,437 | A | * | 12/1986 | Robson et al. | 285/310 |
| 6,123,563 | A | | 9/2000 | Johnson et al. | |
| 6,152,753 | A | * | 11/2000 | Johnson et al. | 439/321 |
| 6,527,575 | B2 | * | 3/2003 | Scholler | 439/321 |
| 6,584,645 | B2 | * | 7/2003 | Migli | 16/341 |
| 2008/0012330 | A1 | * | 1/2008 | Leroyer | 285/386 |
| 2009/0297256 | A1 | * | 12/2009 | Gross, III | 403/105 |

FOREIGN PATENT DOCUMENTS

| | | | |
|---|---|---|---|
| CN | 201667449 | U | 12/2010 |
| EP | 0311338 | A2 | 4/1989 |
| FR | 2473799 | A1 | 7/1981 |
| FR | 2541522 | A1 | 8/1984 |

OTHER PUBLICATIONS

French Search Report, dated Aug. 12, 2010, from corresponding French application.

* cited by examiner

*Primary Examiner* — Joshua Kennedy
(74) *Attorney, Agent, or Firm* — Young & Thompson

(57) ABSTRACT

An anti-unlock screw device (100) for connector designed to maintain the connection between two connection elements (1, 2), includes a cylindrical sleeve (101) provided with a row of saw-tooth notches (105) arranged on an internal circumference of a rear portion. The device also has an internal ring (106) mounted in the rear portion of the cylindrical sleeve so that it can be positioned between the cylindrical sleeve and the first connection element, the internal ring including at least one catch (107) capable of cooperating with the saw-tooth notches of the cylindrical sleeve. A blocking device (110, 111, 112, 113) keeps the internal ring fixed relatively to the cylindrical sleeve in a first sense of rotation (V) and inversely keeps the internal ring free in rotation relatively to the cylindrical sleeve in a second sense of rotation (DV).

12 Claims, 2 Drawing Sheets

ANTI-UNLOCK DEVICE FOR CONNECTOR

BACKGROUND OF THE INVENTION

1. Field of the Invention

The invention pertains to a device preventing involuntary unlocking between two complementary electrical or optical connection elements, such as a receptacle connector and a plug. More specifically, the invention pertains to an anti-unlock device designed to be fixedly joined to one of two connection elements and to be screwed onto the other connection element in order to prevent any involuntary disconnection of the two connection elements.

In certain applications, especially in the field of aeronautic or automobile connection systems, strong vibrations cause the connection elements to move, leading to a loss of linkage between complementary connection elements. Thus, there are known ways of providing each connection system with a device to lock the linkage between the two connection elements and prevent untimely unlocking. Such a device must make it possible to maintain the connection even when the connection systems are subjected to extreme conditions and especially to strong vibrations.

2. Description of the Prior Art

Thus, there is a known locking device with screw comprising a locking ring provided with saw-tooth notches. The locking ring is fixedly joined to one of the connection elements. It then gets screwed onto the second connection element which is provided with a catch that engages onto the saw-tooth notches of the locking ring during the screw-on process. The screwing-on of locking ring is completed when the two connection elements abut each other. The electrical or other connection is thus guaranteed and theoretically maintained.

However, the distance between the two connection elements is not always identical from one connection system to another. Thus, at the end of the locking processes, it can happen that a catch of the connection element around which the locking ring is screwed gets positioned at the tip or along a slope of one of the saw-tooth notches; of said locking ring. Said connection element is therefore in an unstable position relatively to the locking ring. This means that the vibrations to which the connection system is subjected may cause a slight shifting of the locking ring until the catch is brought to a more stable position between two saw-tooth notches. This shifting leads to an equivalent shift as regards the distance between the two connection elements such as a receptacle connector and a plug. And, in certain cases, the connection elements are then no longer in contact, and the electrical or other connection is no longer obtained. Besides, problems of tight sealing may arise because of this spacing, and this should be avoided in pneumatic connectors or electrical or other connectors that are submerged.

SUMMARY OF THE INVENTION

It is an aim of the invention therefore to propose an alternative to the prior-art anti-unlock screw device, that will maintain the connection between two electrical or optical connection elements even under extreme conditions. It is another aim of the invention to provide an anti-unlock device of this kind that is simple to design and/or to assemble.

To this end, the invention proposes to provide the anti-unlock system with an intermediate ring, mounted between the main body of the anti-unlock device and the connection element to which the assembly has to be screwed. This intermediate ring bears the catch or catches that have to get engaged into the saw-tooth notches of the main body. The main body, which is fixedly joined to a first connection element, is capable of being screwed around a second connection element so as to provide for the connection between said two elements and maintain this connection. There is also a blocking device which possible, in a first sense of rotation corresponding for example to the screwing operation, prevents the intermediate ring from rotating relatively to the main body and, inversely, in a second sense of rotation sense, allows such a rotation. This means that the relationship between the catches and the saw-tooth notches is not modified in one sense of rotation whereas in the other sense of rotation the catches get engaged in the saw-tooth notches. It is thus possible to position the catches in a stable position relatively to the saw-tooth notches before the main body is screwed on to the second connection element and to hold them there throughout said screwing operation. Since the position of the catches is not modified by the locking, it remains identical at the end of the screwing operation whatever the locking distance between the two connection elements. Thus, once the anti-unlock system is in a locked position around the corresponding connection element, it is not possible to have any untimely shifting whatsoever of the catches relatively to the saw-tooth notches. The engagement of the catches relatively to the saw-tooth notches takes place only when the main body is unscrewed. Thus, the advantages of such a system using catches/saw-tooth notches are maintained in the anti-unlock system of the invention, without its drawbacks.

An object of the invention therefore is an anti-unlock screw device for connector, especially electrical connectors, designed to maintain the connection between two connection elements, the device comprising:

a cylindrical sleeve designed to be mounted so as to be fixed in translation and free in rotation around a first connection element, said sleeve being provided:

at a front portion, with an internal thread designed to cooperate with an external thread made on a second connection element when the first connection element is engaged in the second connection element, and at a rear portion, with a row of saw-tooth notches arranged on an internal circumference of said rear portion, said saw-tooth notches extending radially towards the interior from the internal wall of the rear portion, an internal ring mounted coaxially in the rear portion of the cylindrical sleeve so that it can be positioned between the cylindrical sleeve and the first connection element, the internal ring comprising at least one catch capable of cooperating with the saw-tooth notches on the rear portion of the cylindrical sleeve, characterized in that it comprises a device for blocking by friction, capable of cooperating with a friction wall to keep said internal ring fixed in rotation relatively to the cylindrical sleeve in a first sense of rotation and inversely to keep said internal ring free in rotation relatively to the cylindrical sleeve in a second sense of rotation, contrary to the first sense of rotation, so as to permit the engaging of said at least one catch into the saw-tooth notches.

The term "internal ring" is understood to mean a circular ring designed to be placed against the internal wall of the cylindrical sleeve to extend coaxially with said cylindrical sleeve and the connection element, so as to be interposed between the cylindrical sleeve and the first connection element, for example a plug, when the anti-unlock device of the invention is in use.

The terms "front portion" and "rear portion" of the cylindrical sleeve are understood with reference to the sense of the connection, the front portion being the portion directed towards the complementary connection element and the rear portion being the opposite portion.

The term "device for locking by friction" is understood to mean a device capable of preventing the rotation of the internal ring in one of the two senses of rotation of the cylindrical sleeve around the second connection element, by contact with a wall, for example a smooth wall.

Advantageously, the first sense of rotation corresponds to the sense of rotation for screwing the cylindrical sleeve on to the second connection element. The second sense of rotation then corresponds to the sense of rotation to enable the unscrewing of the cylindrical sleeve from the second connection element.

Thus, the blocking device of the invention blocks the engagement of the catches in the saw-tooth notches during the screwing operation, for example when the anti-unlock device is rotated clockwise relative to the first connection element. Thus, the blocking device permits such an engagement in the anticlockwise sense.

Classically, the internal ring is provided with at least one catch positioned so as to be facing a row of saw-tooth notches, for example preponderantly, made in the internal wall of the cylindrical sleeve at the rear portion of said sleeve.

Advantageously, in the screwing direction, the catch is in a stable position between two saw-tooth notches. The catch then cannot get engaged in the saw-tooth notches.

In one embodiment, the friction wall may be an insert designed to be mounted so as to be fixed around the first connection element. In another embodiment, the friction wall may be directly made on the external wall of the first connection element.

According to the invention, the blocking device may advantageously comprise a first elastic retracting or return means such as a spring and a bead or another blocking element positioned in a through housing made in the thickness of the internal ring.

In the first sense of rotation, the bead is free in rotation in its housing, thus enabling the internal ring to rotate relatively to the first connection element. More specifically, the internal ring rotates at the same time as the cylindrical sleeve. Inversely, in the second sense of rotation, the bead comes into contact with the friction wall or walls and counters the rotation of the internal ring in the cylindrical sleeve. The internal ring therefore cannot rotate at the same time as the cylindrical sleeve and remains fixed relatively to the first connection element so that the catch on the internal ring gets engaged in the saw-tooth notches of the cylindrical sleeve.

For example, in order to enable the bead of the blocking device to cooperate with the friction wall to counter the rotation of the internal ring, said through housing has a narrowed feature capable of blocking the rotation of the bead in the second sense of rotation.

The invention also pertains to a plug for a connector, especially for an electrical connector, provided with an anti-unlock device according to the invention. Similarly, the invention pertains to a connection assembly comprising a plug, a receptacle connector and an anti-unlock device according to the invention.

BRIEF DESCRIPTION OF THE DRAWINGS

The invention will be understood more clearly from the following description and from the accompanying figures. These figures are given purely by way of an indication and in no way restrict the scope of the invention. Of these figures.

MORE DETAILED DESCRIPTION

Figure 1:
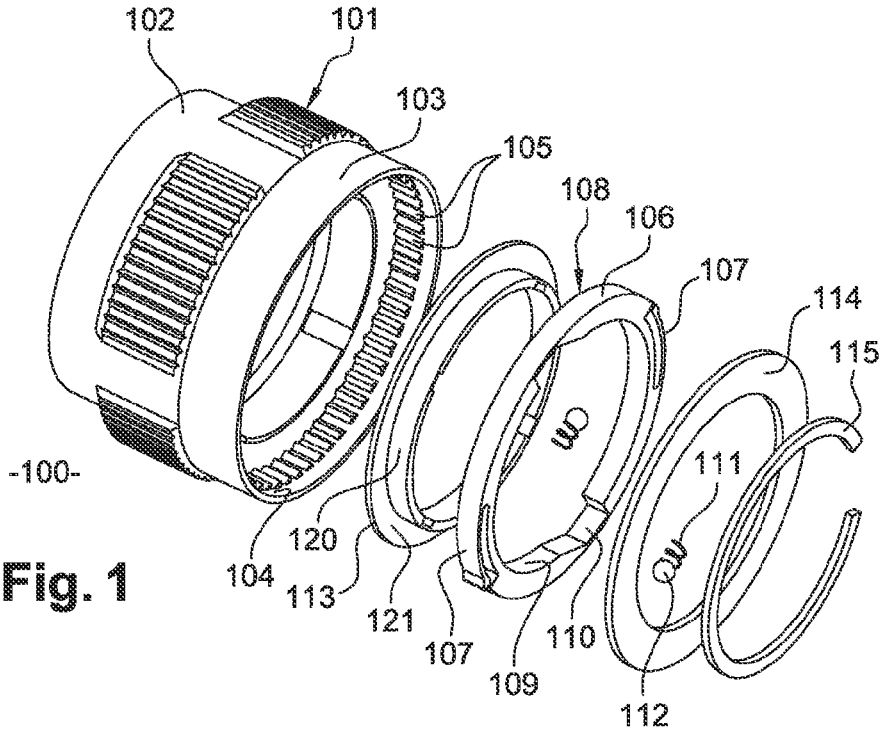
FIG. 1 is an exploded view of an anti-unlock device according to one embodiment of the invention.

FIG. 1 shows an exploded view of the anti-unlock screw device 100 according to one embodiment of the invention.

Figure 2A:
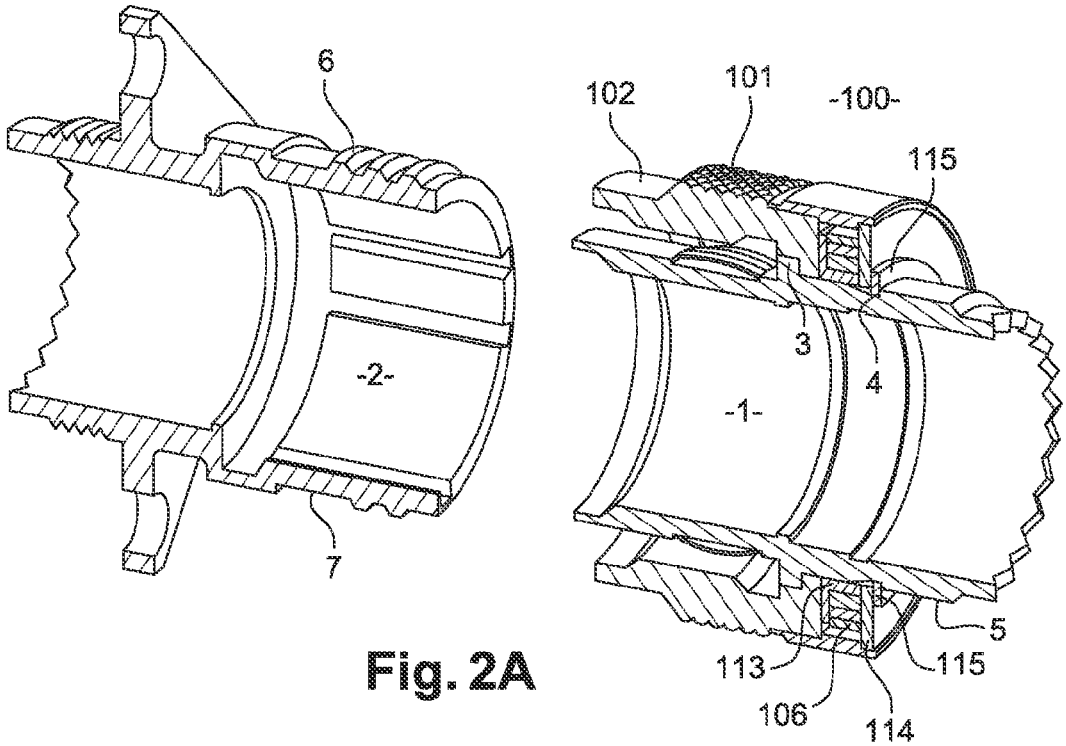
FIGS. 2A and 2B are a view in longitudinal section of a plug and a receptacle connector provided with the anti-unlock device of FIG. 1, in an unconnected position (FIG. 2A) and in a connected position (FIG. 2B)

The anti-unlock device 100 has a cylindrical sleeve 101 designed to be mounted so as to be fixed in translation and free in rotation around a first connection element, such as a plug 1 (FIG. 2A).

Figure 2B:
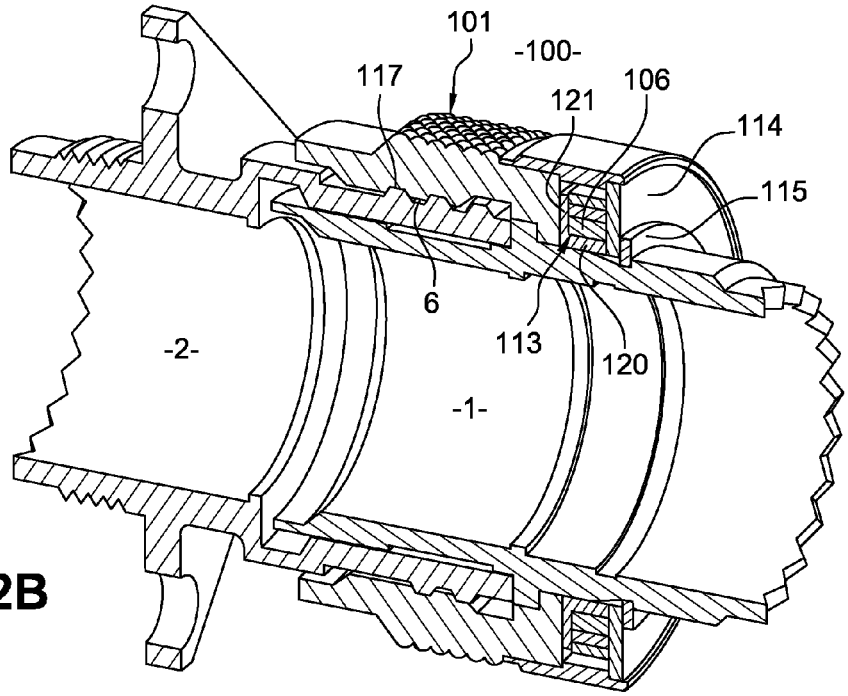

The cylindrical sleeve 101 is provided with a front portion 102 designed to be screwed onto a second connection element such as a receptacle connector 2 (FIG. 2A). To this end, the internal wall of the front portion 102 of the cylindrical sleeve 101 is provided with a thread 117 (shown in detail in FIG. 2B) complementary to a thread 6 made on the external wall 7 of the receptacle connector 2 (FIG. 2B). An internal wall 104 of a rear portion 103 of the cylindrical sleeve 101 is provided with saw-tooth notches 105. More specifically, the saw-tooth notches 105 extend radially from the internal wall 104 of the cylindrical sleeve towards the interior of said sleeve 101.

Figure 3:
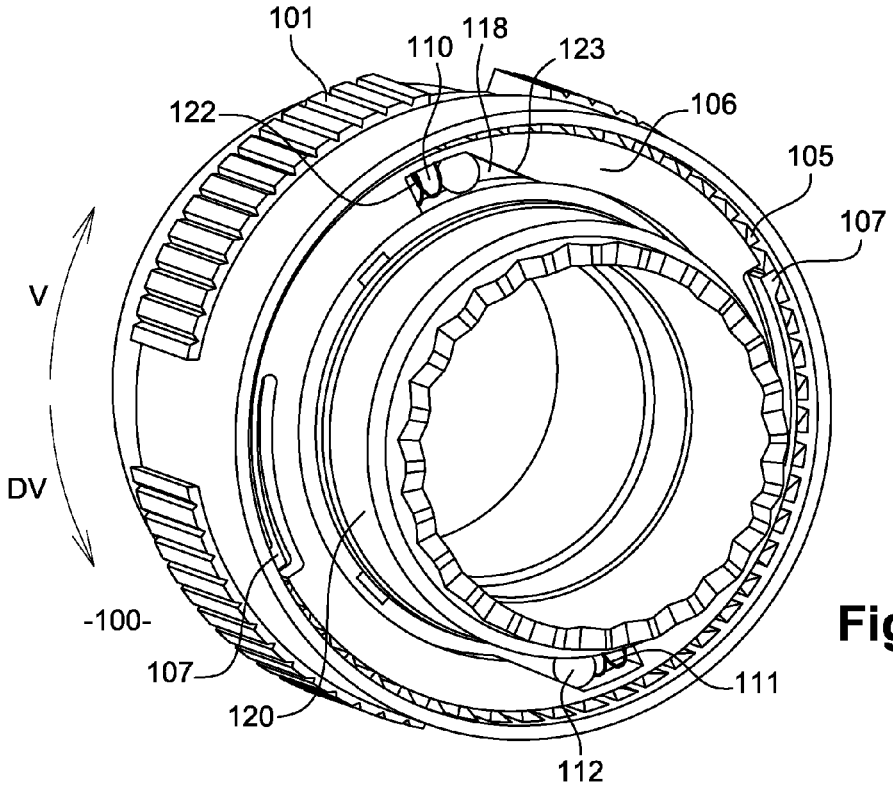
FIG. 3 is a rear view of the anti-unlock device of FIG. 1, around a plug.

An internal ring 106 is designed to be mounted in the cylindrical sleeve 101. The internal ring 106 is provided with two catches 107 made on the external wall 108 of said internal ring 106. The catches 117 extend radially outwards so as to be facing the saw-tooth notches 105 of the cylindrical sleeve 101 (FIG. 3).

In the embodiment shown in the figures, the catches 107 are two in number but this number could be smaller or greater. Furthermore, order to have the elasticity required for getting engaged, the catches 107 are advantageously mounted at the end of flexible arms so that they can bend and thus be capable of passing into each of the saw-tooth notches 105.

Housings 110 or through holes are hollowed out in the thickness of the internal ring 106 from an internal wall of said internal ring 106. The term "internal wall of the internal ring 106" is understood to mean the wall pointing towards the interior of said internal ring 106 opposite the external wall which, for its part, is pointed towards the cylindrical sleeve 101. An elastic element 111 and a bead 112 are housed in each housing 110 (FIG. 3). The housing 110 as well as the springs 111 and the beads 112 belong to the blocking device of the invention.

Naturally, a greater or smaller number of housings 110 (and corresponding beads and springs) can be planned.

The anti-unlock device 100 according to this embodiment of the invention also has a circular base 113 designed to be mounted around the body of the plug 1 (FIG. 2A) so as to be attached to the external wall 5 of said plug 1. The circular base 113 is provided with a side wall 120 extending axially and designed to extend along the external wall of the body of the plug 1, and a radial wall 121 extending radially from the longitudinal wall 120 towards the exterior. Thus, when the anti-unlock device 100 is mounted, the internal ring 106 housed in the cylindrical sleeve 101 surrounds the longitudinal wall 120 of the circular base 113 and rests on the radial wall 121.

A spacer 114 is positioned against the internal ring 106 so as to cover the face of the internal ring 106 opening to the exterior of the cylindrical sleeve and opposite the face of said internal ring resting against the radial wall 121 of the circular base 113. The spacer 114 has a circular and flat shape.

Classically, the cylindrical sleeve 101 is held so as to be fixed in translation on the body of the plug 1 by means firstly of a radial stop 3 and secondly a circlip 115 housed in a notch 4 made on the external wall 5 of said of plug body 1. More specifically, in the example described herein, the radial stop 3 is formed by a circular protruding feature extending radially towards the exterior, from the external wall 5 of the plug body 1.

Thus, when the internal ring 106, the circular base 113 and the spacer 114 are mounted in the cylindrical sleeve 101, itself mounted around the plug body 1, each housing 110 on the internal ring 106 is demarcated on the internal side by the radial wall 121 of the circular base and on the external side by the attached spacer 114 (not shown in FIG. 3).

Each housing 110 extends in the perimeter of the internal ring 106. A first portion 122 of the housing 110 (FIG. 3) has a space sufficient to receive the spring 111 and the bead 112 while at the same time enabling a free rotation of the bead 112 in its housing 110. A second portion 123 of the housing 110 has a narrowed feature 118 such that a height of the housing, at this narrow portion 118, is smaller than the diameter of the bead 112. Thus, if the bead 112 is pushed towards the narrow portion 118, for example by the spring 111, said bead 112 is blocked in rotation and rubs against the radial wall 121 of the circular base 113 and against the spacer 114. Inasmuch as the circular base 113 and the spacer 114 are fixed relatively to the plug 1, these frictional forces counter the rotation of the internal ring 106 relatively to the plug 1.

The connection and the locking of the plug 1 to the receptacle connector 2 are done conventionally (FIGS. 2A and 2B). Initially, the receptacle connector 2 provided with an insert comprising contacts (not shown) and the plug 1, also provided with an insert and contacts (not shown) are connected to each other by a motion of translation. Then, the cylindrical sleeve 101 is screwed onto the receptacle connector 2 until the receptacle connector 2 mechanically abuts the plug 1.

During this step of screwing on along a first sense of rotation V, the catches 107 on the internal ring 106 do not engage into the saw-tooth notches 105 of the cylindrical sleeve 101. For example, the saw-tooth notches 105 have a shape such that the catches 107 remain fixed in position between two saw-tooth notches (FIG. 3) during the screwing operation. Thus, when the cylindrical sleeve 101 is screwed around the body of the receptacle connector 2, the internal ring 106 rotates at the same time as the cylindrical sleeve 101 around the receptacle connector 2 and the plug 1. The blocking device is not actuated. More specifically, each bead is free in rotation in its housing 110. The rotation of the internal ring 106 is therefore accompanied by the rotation of the beads 112 in their housing 110. Indeed, the shape and orientation of the housings 110 are such that the bead, during the screwing operation, is held in the first portion 122 of its housing 110.

Thus, once the plug 1 abuts the receptacle connector 2, the catches 107 are in the same stable position as they were before the locking, i.e. between two saw-tooth notches 105. This position therefore cannot be modified in an untimely way, for example by strong vibrations.

When it is desired to detach the plug 1 from the receptacle connector 2, the anti-unlock device 100 is unscrewed by turning the cylindrical sleeve 101 along a second sense of rotation DV so that the plug 1 can be withdrawn by translation. During this rotation DV, each bead 112 in the corresponding housing 110 is pushed back by the spring 111 into the portion 123 comprising the narrowed feature 118. Indeed, the spring 111 is fixed into the first portion 122 and the bead 112 for its part is positioned between the spring 111 and the narrowed feature 118. Thus, during the rotation in the unscrewing sense DV, the bead 112 is pushed by the spring 111 in the sense opposite to that of the unscrewing, towards the narrowed feature 118. The bead 112 thus wedged into the narrowed feature 118, rubs against the radial wall 121 of the circular base 113 and against the spacer 114 so that it can no longer roll. The internal ring 106 is then fixed relatively to the circular base 113 which itself is fixed relatively to the plug 1. Thus, the internal ring 106 is rotationally blocked relatively to the plug 1 when the cylindrical sleeve 101 is unscrewed from the base 2.

This means that the unscrewing of the cylindrical sleeve 101 applies force to the catches 107. The catches 107 get engaged into the saw-tooth notches 105 of the cylindrical sleeve 101. The presence of these saw-tooth notches 105 and catches 107 in the anti-unlock device 100 of the invention therefore dictates the application of a major degree of force to carry out the unscrewing, said unscrewing being accompanied by a clicking noise informing the user of said unscrewing.

The invention claimed is:

1. An anti-unlock screw device for a connector configured to maintain the connection between two connection elements, the device comprising:

a cylindrical sleeve mounted to be fixed in translation and free in rotation around a first of the connection elements, said sleeve comprising an internal thread at a front portion of the sleeve, the internal thread configured to cooperate with an external thread made on a second of the connection elements when the first connection element is engaged in the second connection element, and a row of saw-tooth notches arranged on an internal circumference of a rear portion of the sleeve, said saw-tooth notches extending radially towards an interior from an internal wall of the rear portion; and an internal ring mounted coaxially in the rear portion of the cylindrical sleeve and positioned between the cylindrical sleeve and the first connection element, the internal ring comprising at least one catch configured to cooperate with the saw-tooth notches on the rear portion of the cylindrical sleeve, and a blocking device configured to block by friction and configured to cooperate with a friction wall and a circular spacer, the friction wall and the circular spacer both configured to be fixed relative to the first connection element to keep said internal ring fixed in rotation relative to the cylindrical sleeve in a first direction of rotation so that the internal ring rotates at the same time as the first connection element, and, inversely, configured to keep said internal ring free in rotation relative to the cylindrical sleeve in a second direction of rotation opposite the first direction of rotation to permit the at least one catch to engage into the saw-tooth notches of the cylindrical sleeve, the blocking device comprising an elastic return means, and a bead positioned in a through housing formed in the thickness of the internal ring, the bead being free in rotation in the through housing, the through housing having a narrowed feature configured to block the bead, in rotation, in the second direction of rotation when the bead is pushed towards the narrowed feature, the bead rubbing against the friction wall and the circular spacer.

2. The anti-unlock screw device for the connector according to claim 1, wherein the first direction of rotation corresponds to rotation of the cylindrical sleeve to enable the screwing of said cylindrical sleeve around the second connection element and the second direction of rotation corresponds to rotation of the cylindrical sleeve to enable the unscrewing of said cylindrical sleeve around the second connection element.

3. The anti-unlock screw device for the connector according to claim 2, wherein the internal ring is held between the friction wall and the circular spacer, the circular spacer being designed to be fixed relative to the first connection element.

4. The anti-unlock screw device for the connector according to claim 1, wherein the blocking device cooperates with the friction wall on one side of the blocking device and with the circular spacer on another side of the blocking device.

5. A plug for a connector provided with the anti-unlock screw device according to claim 1, the plug being designed to keep said plug connected to a complementary receptacle connector.

6. The plug according to claim 5, wherein the friction wall of the anti-unlock device is attached around said plug.

7. The plug according to claim 5, wherein the friction wall of the anti-unlock device is made on an external wall of said plug.

8. The plug according to claim 5, wherein the at least one catch of the internal ring is in a stable position between two saw-tooth notches of the cylindrical sleeve before and after the screwing of said cylindrical sleeve around the complementary receptacle connector.

9. The plug according to claim 6, wherein the at least one catch of the internal ring is in a stable position between two saw-tooth notches of the cylindrical sleeve before and after the screwing of said cylindrical sleeve around the complementary receptacle connector.

10. The plug according to claim 7, wherein the at least one catch of the internal ring is in a stable position between two saw-tooth notches of the cylindrical sleeve before and after the screwing of said cylindrical sleeve around the complementary receptacle connector.

11. A connection assembly comprising a plug according to claim 5 and a complementary receptacle connector, the anti-unlock device being configured to be screwed around said receptacle connector to maintain a connection between said plug and said receptacle connector.

12. for the connector, the plug being provided with the anti-unlock screw device according to claim 2, the plug being configured to keep said plug connected to a complementary receptacle connector.

* * * * *